United States Patent [19]

Hay

[11] 4,072,445

[45] Feb. 7, 1978

[54] ROTARY GAS PRESSURE ENGINE SYSTEM

[76] Inventor: Johnny L. Hay, 1001 Willow Ridge Road, Fort Worth, Tex. 76103

[21] Appl. No.: 708,895

[22] Filed: July 26, 1976

[51] Int. Cl.[2] ..... F04B 17/00; F04B 35/00; F01B 13/06

[52] U.S. Cl. ..... 417/379; 417/405; 91/498

[58] Field of Search ..... 91/491, 492, 498; 417/199 R, 405, 406, 391, 379, 491, 492, 498

[56] References Cited

U.S. PATENT DOCUMENTS

| | | | |
|---|---|---|---|
| 1,000,539 | 8/1911 | Nauer | 91/498 |
| 1,533,514 | 4/1925 | Ragot | 91/492 |
| 2,363,162 | 11/1944 | Tripp | 91/498 |
| 2,575,074 | 11/1951 | Sonninger | 417/199 R |
| 2,655,110 | 10/1953 | Sanborn | 417/199 R |
| 2,660,123 | 11/1953 | Vlachos | 417/406 |
| 3,045,899 | 7/1962 | Maher et al. | 417/406 |
| 3,178,102 | 4/1965 | Grisbrook | 417/406 |
| 3,391,538 | 7/1968 | Orloff et al. | 417/225 |
| 3,806,281 | 4/1974 | Skinner | 417/391 |

FOREIGN PATENT DOCUMENTS

| | | | |
|---|---|---|---|
| 571,319 | 8/1945 | United Kingdom | 91/498 |

*Primary Examiner*—William L. Freeh
*Attorney, Agent, or Firm*—Richards, Harris & Medlock

[57] ABSTRACT

The specification discloses a rotary gas pressure engine system including a housing and a stationary shaft extending through the housing. A circular cylinder block is rotatably mounted on the stationary shaft. The cylinder block includes a plurality of radial piston cylinders and a piston mounted within each cylinder for slidable movement therein. The cylinder block further includes a circumferentially mounted cam ring having generally elliptical risers around its inner periphery in order to cause radial operation of the pistons. A vane pump is associated with the cylinder block for pumping fluid from a fluid reservoir external of the housing and through the housing to a vaporization chamber external of the housing.

15 Claims, 5 Drawing Figures

ROTARY GAS PRESSURE ENGINE SYSTEM

FIELD OF THE INVENTION

This invention relates to rotary gas pressure engines, and more particularly relates to a rotary gas pressure engine including an internally housed vane pump.

THE PRIOR ART

Rotary gas pressure engines have previously been developed to operate on pressurized air, steam and other gases. For example, prior rotary gas pressure engines are described in U.S. Pat. No. 719,046 by O. G. Rieske, issued Jan. 27, 1903 and U.S. Pat. No. 1,562,769 by L. B. Hubbard, issued Nov. 24, 1925. However, such previously developed engines have not been completely satisfactory with respect to power output and economy of operation. Moreover, prior engines have not been incorporated in an overall system which maximized efficiency and power. Such prior systems have also often required expensive and bulky separate pumps for pressurizing the gas for operation of the motor.

SUMMARY OF THE INVENTION

The present invention substantially eliminates and reduces the problems heretofore associated with powerful prior art devices and provides an extremely efficient and powerful motor and pump combination in a total gas powered motor system.

In accordance with the present invention, a rotary gas pressure engine includes a housing and a stationary shaft extending through the housing. A circular cylinder block is rotatably mounted to the stationary shaft. The cylinder block includes a plurality of radial piston cylinders, and a piston mounted therein for slidable movement. The cylinder block further includes a circumferentially mounted cam ring having generally elliptical risers around its inner periphery. The housing further includes a vane pump for pumping fluid from a fluid reservoir external of the housing and through the housing to a vaporization chamber external of the housing.

In accordance with a more specific aspect of the invention, a rotary gas pressure engine includes a housing and a normally stationary shaft extending through the housing. A circular cylinder block is rotatably mounted on the stationary shaft. A rotor is mounted on the cylinder block for rotation therewith and includes a plurality of substantially radial slots. A vane is mounted within each of the plurality of radial slots for slidable movement therein between a fully extended position and a fully retracted position. A casing is mounted within the housing normal to the shaft and adjacent the rotor to enclose the vanes. The casing includes an internal eccentric bore such that when the rotor is rotated the vanes are caused to slide within the radial slots between the fully extended and retracted positions in a radial direction by contacting the periphery of the eccentric bore. The casing further includes a fluid intake port and a fluid discharge port such that fluid is trapped between extended vanes when the vanes are rotated past the fluid intake port. The fluid is carried around the casing and is forced out through the fluid discharge port as the eccentricity of the casing causes the radial extension of the vanes from the slots to slide to the fully retracted position, thereby permitting the fluid to discharge from the casing through the fluid discharge port.

DESCRIPTION OF THE DRAWINGS

For a more detailed description of the present invention and for further objects and advantages thereof, reference is now made to the following detailed description taken in conjunction with the accompanying drawings, in which.

DESCRIPTION OF THE PREFERRED EMBODIMENT

Figure 1:
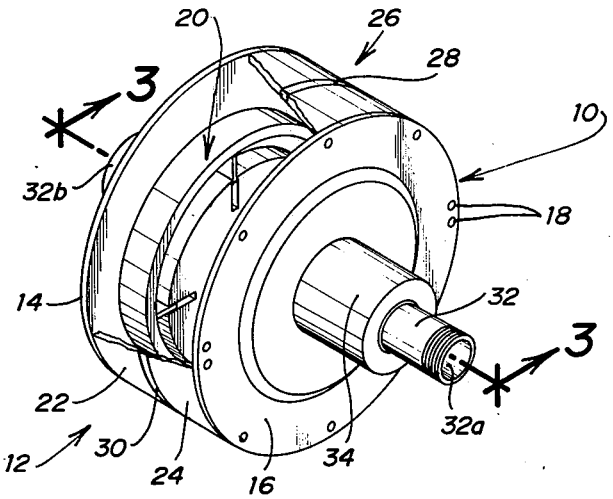
FIG. 1 is a perspective view of the rotary gas pressure engine of the present invention; with a portion of the engine housing broken away and the engine structure removed to expose the vane pump.
Figure 3:
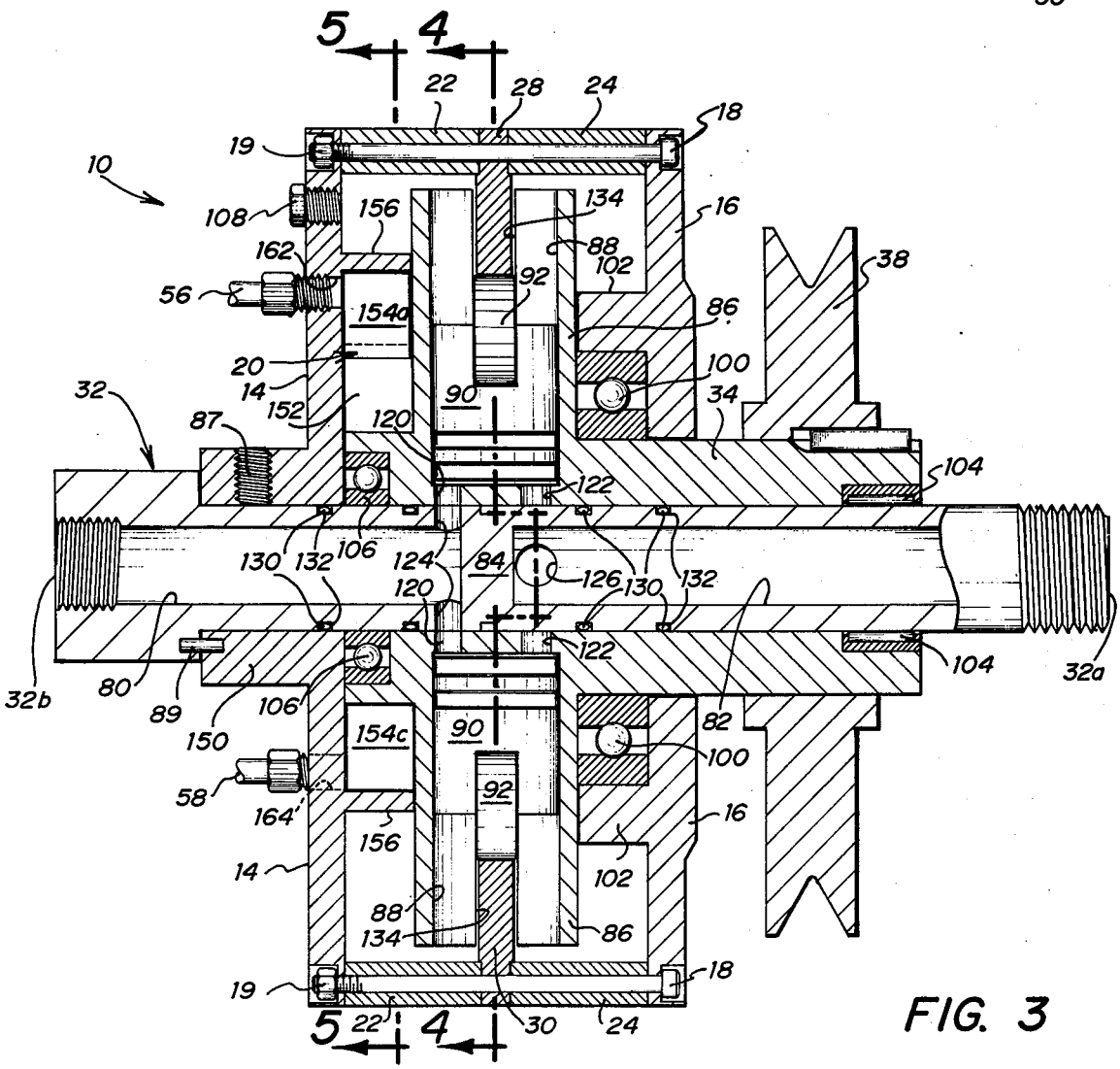
FIG. 3 is a sectional view taken generally along the sectional lines 3—3 of the rotary gas pressure engine of the present invention in FIG. 1.

FIG. 1 illustrates the rotary gas pressure engine of the present invention and is identified generally by the numeral 10. The engine 10 of the present system includes a cylindrical housing, which is identified generally by the numeral 12. Cylindrical housing 12 includes a first housing plate 14 and a second housing plate 16. Plates 14 and 16 are secured to each other by bolts 18 and nuts 19 (FIG. 3). Contained within cylindrical housing 12 is a vane pump, which is identified generally by the numeral 20. The vane pump 20 will be subsequently described in connection with FIGS. 3 and 5. Within the circumference of plates 14 and 16 and on the opposing surfaces thereof, spacer rings 22 and 24 are respectively located.

A cam ring identified generally by numeral 26 is located between spacer rings 22 and 24. Cam ring 26 comprises an upper portion 28 and a lower portion 30. As best illustrated in FIG. 3, the bolts 18 extend through the housing plates 14 and 16, spacer rings 22 and 24 and the cam ring 26. The cam ring 26 is composed of the upper and lower parts 28 and 30 for convenience when assembling the engine 10. A stationary shaft 32 extends through the axial centers of the housing plates 14 and 16. A tubular drive shaft 34 is mounted to shaft 32 and extends inwardly through the second housing plate 16.

Figure 2:
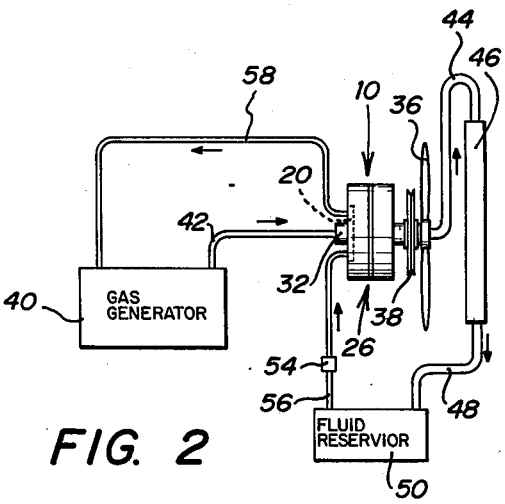
FIG. 2 is a pictorial illustration of the rotary gas pressure engine in its operating environment.

Referring now to FIG. 2, the general operation of the engine 10 in the present system will be described. A cooling fan 36 and a power drive take-off 38 are mounted to shaft 34 at the exhaust end of engine 10. In operation of the present system, a fluid such as water or a nonflammable fluorinated hydrocarbon liquid such as Freon, a common refrigerant, is vaporized by supplying heat from an exterior source to a gas generator 40. The vaporized fluid in its gaseous state is applied under pressure through pipeline 42 to the intake portion of engine 10. The gas causes operation of the four pistons, to be subsequently described, within the engine 10 to rotate the drive shaft 34 and cooling fan 36. The gas is exhausted from the engine 10 through a pipeline 44 into a condenser 46. The operation of the cooling fan 36 and condenser 46 can be utilized to provide air cooling for building structures.

The condensed gas, now a liquid, flows through pipeline 48 into a fluid reservoir 50. Through the operation of the vane pump 20 the fluid is pumped from the fluid reservoir 50 into the gas generator 40 to repeat the fluid-gas-fluid cycle. The vane pump 20 pumps the fluid from the fluid reservoir 50 through a check valve 54, which will only permit fluid to flow into the engine housing 12. The fluid leaving the fluid reservoir 54 flows through a pipeline 56. The fluid exits from the engine housing 12 via a pipeline 58 to enter the gas generator 40.

The vane pump 20 functions to recirculate the fluid from the fluid reservoir through engine housing 12 to the gas generator 40 in such a manner to maintain the gas pressure within the engine 10 thereby increasing the efficiency of the engine 10. The present system therefore, incorporates the vane pump 20 within the housing 12 to form a self-contained gas pressure engine system which is compact and extremely efficient in operation. The overall system eliminates the need for an expensive and bulky separate pump for pressurizing the gas for operation of the system motor.

Figure 4:
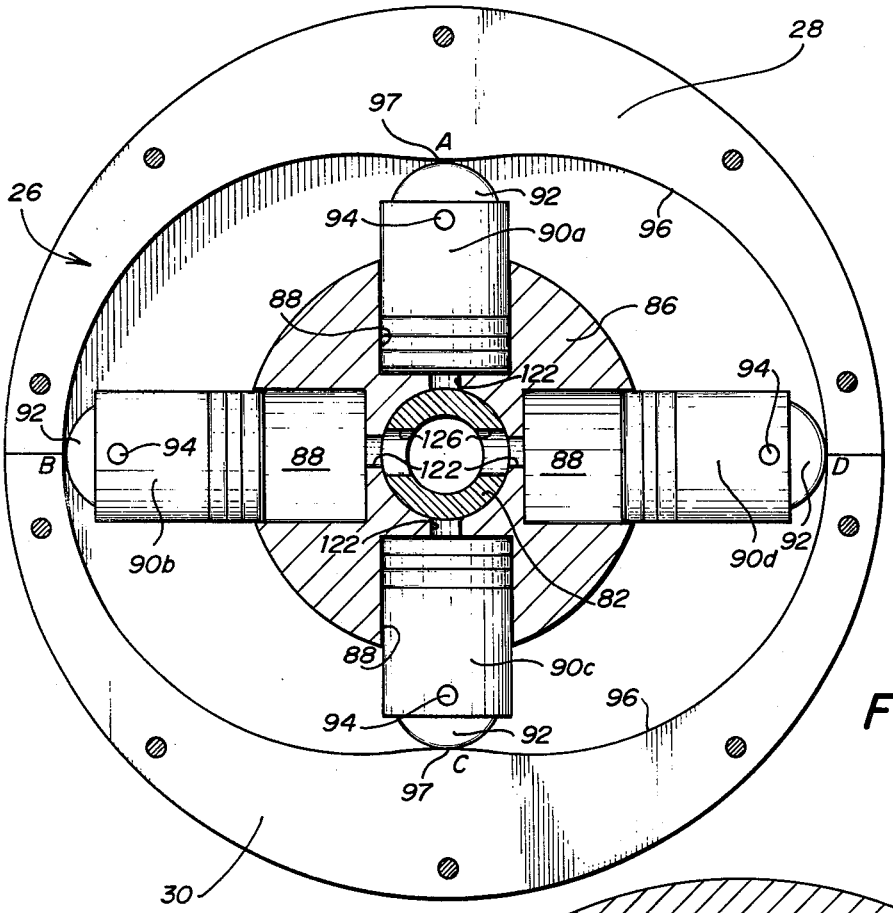
FIG. 4 is a sectional view taken generally along the sectional lines 4—4 of the rotary gas pressure engine of the present invention shown in FIG. 3.

Referring simultaneously to FIGS. 3 and 4, stationary shaft 32 is comprised of an intake tube 80 aligned with an exhaust tube 82. Between the interior adjacent ends of tubes 80 and 82 is a transverse closure member 84. Shaft 32 is secured to the first housing plate 14 by a set screw 87 and is keyed to the plate 14 by an indexing pin 89.

Rotatably mounted on the shaft 32 and spanning the interior adjacent ends of the intake and exhaust tubes 80 and 82 respectively is a circular cylinder block 86. Cylinder block 86 includes opposing radial cylinders 88, which are open at their exterior ends. Mounted for slidable movement within each cylinder 88 is a piston identified generally by the numeral 90 and specifically by the numerals 90*a*, 90*b*, 90*c* and 90*d*. The exterior end of each piston 90 projects from its associated piston cylinder 88. Attached to each end of the pistons 90 is a roller 92, which makes rolling contact with the inner periphery of the cam ring 26. The inner periphery 96 of cam ring 26 is generally elliptical in shape to provide opposing cam risers 97 at locations A and C along the periphery 96.

Tubular drive shaft 34 extends inwardly through the second housing plate 16 where it is secured to the cylinder block 86. An antifriction bearing 100 is located around shaft 34 and engages the outer circumference of the drive shaft 34 and a bearing race 102 extending from housing plate 16. A press needle bearing 104 engages the inner circumference of the drive shaft 34 and the outer circumference of shaft 32. An antifriction bearing 106 engages the outer circumference of shaft 32 and the cylinder block 86. A filler plug 108 is threaded in one end of the housing plate 14 for permitting the filling of housing 12 with a liquid lubricant.

Located in the interior ends of each cylinder 88 is an intake port 120 and an exhaust port 122. Located in the interior end of intake tube 80 is an intake port 124, which registers with the cylinder 88 intake port 120. Located in the interior end of exhaust tube 82 is an exhaust port 126, which registers with the exhaust ports 122 of cylinders 88. As is more clearly shown in FIG. 4, the exhaust port 126 will simultaneously register with opposing cylinder exhaust ports 122 to permit exhaust of the cylinders 88 and in the B and D positions. This registration is accomplished through the prealignment of shaft 32 and the housing 12 utilizing the indexing pin 87.

Ring seals 130 are provided around the shaft 32 and are received in grooves 132. The seals 130 make contact with the interior circumference of the housing plates 14 and 16 and the cylinder block 86 on each side of the ports 120 and 122. A circumferential slot 134 is included in the cylinder block 86 to accommodate the cam ring 26.

In the operation of the engine 10 of the present system, gas under pressure is admitted to opposing cylinders 90 through the intake tube 80 of shaft 32. The gas flows to the interior end of intake tube 80 through the port 124 and into the cylinder 88 via the cylinder intake port 120. During the intake portion of the engine cycle pistons 90*a* and 90*c* are located in their fully retracted position under the influence of the risers 97 of cam ring 26. Upon one-quarter turn of the cylinder block 86 the pistons 90*a* and 90*c* will be fully extended corresponding to the position of pistons 90*b* and 90*d*. In this position the exhaust ports 122 of cylinders 88 will register with the exhaust port 126 in the exhaust tube 82 of shaft 32. To complete a half-cycle of operation, the cam ring 26 will then force the pistons 90*a* and 90*c* back to their fully retracted position within cylinders 88 such that piston 90*a* will be in position C and piston 90*c* will be in position A to intake gas and begin the power stroke.

Figure 5:
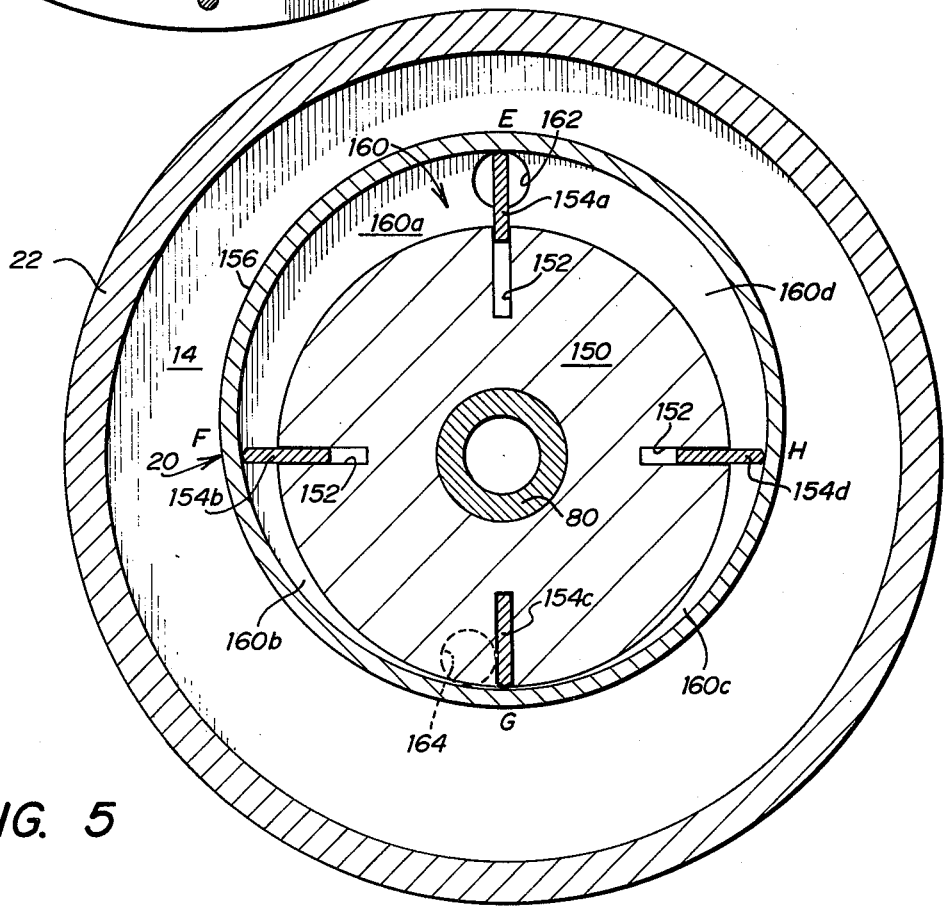
FIG. 5 is a sectional view taken generally along the sectional lines 5—5 of the rotary gas pressure engine of the present invention shown in FIG. 3.

Referring simultaneously to FIGS. 3 and 5, the vane pump 20 is illustrated. The vane pump 20 includes a rotor 150, which is an extension of block 86. The rotor 150 includes radial slots 152, which are open at their exterior ends and closed centrally between the periphery and center of rotor 150. Mounted for slidable movement within each slot 152 is a vane identified generally by numeral 154 and specifically by numerals 154*a*, 154*b*, 154*c* and 154*d*.

A circular flange 156 extends from housing plate 14 to form a casing for the vanes 154*a–d*. The flange 156 is located eccentric with respect to shaft 32, such that the distance between the center of shaft 32 and position E is greater than the distance between the center of shaft 32 and the position G. The vanes 154*a–d* are slidable between a fully retracted position as shown by vane 154*c* in the position G and a fully extended position shown by vane 154*a* in position E. The flange 156 operates to restrain the vanes 154 within the vane slots 152 such that even in the fully extended position, a vane 154 will not disengage from the vane slot 152.

The vanes 154*a–d* are held against the interior perimeter of flange 156 by centrifugal force when the cylinder block 86 is turned by operation of the engine 10. The eccentricity of the flange 156 causes the vanes 154 to move from their fully extended position (vane 154*a*) to a fully retracted position (vane 154*c*). The centrifugal force generated by the rotary motion of the rotor 150 causes the vanes to move from their fully retracted position (vane 154*c*) to their fully extended position (vane 154*a*).

A fluid chamber identified generally by the numeral 160 is formed in the vane pump 20. The boundaries of the chamber 160 include the interior surface of housing plate 14, the exterior surface of cylinder block 86 and the interior perimeter of the casing flange 156. Fluid enters the fluid chamber 160 through a fluid intake port 162. Intake port 162 is interconnected to the fluid reservoir 50 by pipeline 56 (FIG. 2). A fluid discharge port 164 is located opposite the fluid intake port 162 in housing plate 14. Fluid discharge port is interconnected to the gas generator 40 by pipeline 58 (FIG. 2).

In operation of the vane pump 20 of the present gas pressure engine system, fluid is trapped between pairs of vanes 154 as they pass the fluid intake port 162. Fluid is drawn into the fluid chamber 160 by suction forces generated by the rotating vanes 154. The fluid is then carried around the fluid chamber 160 and forced out through the fluid discharge port 164 as the eccentricity of the flange case 156 reduces the spacing between the vanes 154 and the casing 156 to zero. During the operating cycle of the vane pump 20, fluid is present between vanes 154*a* and 154*b* in the portion of fluid chamber 160 identified as 160*a*. The fluid is then carried between vanes 154*a* and 154*b* to the chamber portion 160*b*, where it is forced out through the fluid discharge port 164. While the fluid is being discharged through port 164, fluid is drawn into the chamber portion 160*d*.

The portion of fluid chamber 160 identified as 160*c* is void of fluid since all fluid has been discharged through port 164 immediately before a vane 154 reaches portion 160*c*. Since the area between vanes 154*c* and 154*d* is void of fluid, a suction is created to draw fluid into the intake port 162 as the vanes rotate towards area 160*d*. In general, fluid first fills the chamber portion 160*d*, then is carried around the chamber through portion 160*a* and is forced out of the chamber in chamber portion 160*b*. Generally, no fluid is present during the pumping cycle in chamber portion 160*c*.

It will thus be seen that the vane pump 20 delivers a continous flow of fluid from the fluid reservoir 50 to the gas generator 40 to provide a constant gas pressure for operation of the engine 10. The vane pump 20 is simple in construction and operation having no valves to be opened and closed with each successive quantity of fluid delivered. The pump is suitable to handle a variety of fluids so as not to restrict the operation of engine 10 to a particular fluid.

It will thus be seen that the rotary gas pressure engine system of the present invention provides for an efficient operating gas pressure engine and one which is compact in size. The engine housing contains a vane pump which operates with the rotor of the gas pressure engine to provide an efficiently operating pump for pressurizing the gas for operation of the motor. The self-contained pump thereby eliminates the need for external pumps, which are not only expensive and bulky but also tend to lessen the overall efficiency of the engine system. The incorporation of a pump within the gas pressure engine to form an overall system maximizes the efficiency and power of the gas pressure engine, while minimizing the total number of parts and cost.

Whereas the present invention has been described with respect to specific embodiments thereto, it will be understood that various changes and modifications will be suggested to one skilled in the art and it is intended to encompass such changes and modifications which fall within the scope of the appended claims.

What is claimed is:

1. A rotary gas pressure engine comprising:

a housing;

a stationary shaft extending through said housing;

a circular cylinder block rotatably mounted on said stationary shaft;

said cylinder block including a plurality of radial piston cylinders formed therein;

said housing including a circumferentially mounted cam ring having generally elliptical risers around its inner periphery;

a plurality of pistons mounted for slidable movement within said piston cylinders and including means for bearing against said cam ring;

drive means connected to said cylinder block and extending external of said housing for driving a power take-off;

a gas generator for supplying gas to said cylinder block to cause movement of said pistons and rotation of said cylinder block; and means within said housing and rotatably with said cylinder block for pumping fluid to said gas generator.

2. The rotary gas pressure engine of claim 1 wherein said means for pumping fluid comprises:

a vane pump rotatable with said cylinder block and including a plurality of sliding vanes.

3. The rotary pressure engine of claim 1 wherein said means for pumping fluid comprises:

a rotor mounted to said block for rotation therewith and having a plurality of substantially radial slots;

a vane mounted within each of said plurality of substantially radial slots for slidable movement therein between a fully extended position and a fully retracted position;

a casing mounted within said housing, normal to said shaft and adjacent said rotor to enclose said vanes;

said casing having an internal eccentric bore such that when said rotor is rotated said vanes are caused to slide within said slots between said fully extended and retracted positions in a radial direction by contacting the periphery of said eccentric bore; and said casing further including a fluid intake port and a fluid discharge port such that fluid is trapped between said vanes in said fully extended position when said vanes are rotated past said fluid intake port, said fluid is carried around said casing and is forced out through said fluid discharge port as the eccentricity of the casing causes the radial extension of said vanes from said slots to slide to said fully retracted position thereby permitting said fluid to discharge from said casing through said fluid discharge port.

4. The rotary gas pressure engine of claim 1 wherein said stationary shaft includes aligned intake and exhaust tubes having a closure member therebetween.

5. The rotary gas pressure engine of claim 4 wherein each of said plurality of piston cylinders includes an intake and an exhaust port in the inner ends of said piston cylinders and respectively positioned around said stationary shaft intake and exhaust tubes.

6. The rotary gas pressure engine of claim 5 wherein said intake tube includes intake ports for aligning with said intake ports of said piston cylinders; and said exhaust tube includes exhaust ports for aligning with said exhaust ports of said piston cylinders.

7. The rotary gas pressure engine of claim 6 wherein said pistons include means for contacting said cam ring risers such that said intake port and exhaust ports in said intake and exhaust tubes are arranged to extend said pistons against said cam risers on power strokes and to exhaust said piston cylinders on exhaust strokes.

8. A rotary gas pressure engine system comprising:

a housing having first and second housing plates separated by first and second spacer rings;

a cam ring having upper and lower halves carried in said housing between the first and second spacer rings;

said cam ring having generally elliptical risers positioned along its inner periphery;

a stationary shaft extending through said housing plates;

said stationary shaft including aligned intake and exhaust tubes and having a closure member therebetween;

a circular cylinder block rotatably mounted on said stationary shaft and extending over the adjacent interior ends of said intake and exhaust tubes;

said cylinder block including a plurality of radial piston cylinders formed therein;

each of said plurality of piston cylinders including an intake and an exhaust port in the inner ends of said piston cylinders and respectively positioned around said shaft intake and exhaust tubes;

said intake tube including intake ports for aligning with said intake ports of said piston cylinders;

said exhaust tube including exhaust ports for aligning with said exhaust ports of said piston cylinders;

a plurality of pistons mounted for slidable movement within said piston cylinders;

said pistons including means for contacting said risers of said cam ring such that said intake ports and exhaust ports in said intake and exhaust tubes are arranged to extend said pistons against said cam risers on power strokes and to exhaust said piston cylinders on exhaust strokes;

a drive shaft connected to said cylinder block and extending through one of the housing plates;

said drive shaft being tubular and concentrically positioned around said stationary shaft and adapted for rotation therearound;

a gas generator for supplying gas to said cylinder block to cause movement of said pistons and rotation of said cylinder block; and a pump within said housing and rotatable with said cylinder block for pumping fluid to said gas generator.

9. The rotary gas pressure engine of claim 8 wherein said means for pumping fluid comprises:

a rotor mounted to said block for rotation therewith and having a plurality of substantially radial slots;

a vane mounted within each of said plurality of substantially radial slots for slidable movement therein between a fully extended position and a fully retracted position;

a casing mounted within said housing, normal to said shaft and adjacent said rotor to enclose said vanes;

said casing having an internal eccentric bore such that when said rotor is rotated said vanes are caused to slide within said slots between said fully extended and retracted positions in a radial direction by contacting the periphery of said eccentric bore; and said casing further including a fluid intake port and a fluid discharge port such that said fluid is trapped between said vanes in said fully extended position when said vanes are rotated past said fluid intake port, said fluid is carried around said casing and is forced out through said fluid discharge port as the eccentricity of the casing causes the radial extension of said vanes from said slots to slide to said fully retracted position thereby permitting said fluid to discharge from said casing through said fluid discharge port.

10. The rotary gas pressure engine of claim 8 wherein said circular cylinder block further includes a groove therearound to receive said risers of said cam ring.

11. The rotary gas pressure engine of claim 8 wherein said means for contacting said risers includes roller means mounted to the outer ends of each of said plurality of pistons.

12. A rotary gas pressure engine comprising:

a housing;

a stationary shaft extending through said housing;

said stationary shaft including aligned intake and exhaust tubes and having a closure member therebetween;

a circular cylinder block rotatably mounted on said stationary shaft and extending over the adjacent interior ends of said intake and exhaust tubes;

said cylinder block including a plurality of radial piston cylinders formed therein;

said cylinder block further including a circumferentially mounted cam ring having generally elliptical risers around its inner periphery;

each of said plurality of piston cylinders including an intake and an exhaust port in the inner ends of said piston cylinders and respectively positioned around said shaft intake and exhaust tubes;

said intake tube including intake ports for aligning with said intake ports of said piston cylinders;

said exhaust tube including exhaust ports for aligning with said exhaust ports of said piston cylinders;

a plurality of pistons mounted for slidable movement within said piston cylinders;

said pistons including means for contacting said risers of said cam ring such that said intake ports and exhaust ports in said intake and exhaust tubes are arranged to extend said pistons against said cam risers on power strokes and to exhaust said piston cylinders on exhaust strokes;

drive means connected to said cylinder block;

a gas generator for supplying gas to said cylinder block to cause movement of said pistons and rotation of said cylinder block;

said housing further including a pump rotor mounted to said block for rotation therewith and having a plurality of substantially radial slots;

a vane mounted within each of said plurality of substantially radial slots for slidable movement therein between a fully extended position and a fully retracted position;

said housing further including a casing mounted normal to said shaft and adjacent said rotor to enclose said vanes;

said casing having an internal eccentric bore such that when said rotor is rotated said vanes are caused to slide within said slots between said fully extended and retracted positions in a radial direction by contacting the periphery of said eccentric bore; and said casing further including a fluid intake port and a fluid discharge port such that said fluid is trapped between said vanes in said fully extended position when said vanes are rotated past said fluid intake port, said fluid is carried around said casing and is forced out through said fluid discharge port as the eccentricity of the casing causes the radial extension of said vanes from said slots to slide to said fully retracted position thereby permitting said fluid to discharge from said casing through said fluid discharge port.

13. The rotary gas pressure engine of claim 12 wherein said drive means connected to said cylinder block includes a tubular shaft rotatably mounted on said normally stationary shaft and extending outwardly of said housing.

14. The rotary gas pressure engine of claim 12 wherein said circular cylinder block further includes a groove therearound to receive said risers of said cam ring.

15. The rotary gas pressure engine of claim 12 wherein said means for contacting said risers includes roller means mounted to the outer ends of each of said plurality of pistons.

* * * * *